US010093463B2

(12) United States Patent
Zalewski

(10) Patent No.: US 10,093,463 B2
(45) Date of Patent: Oct. 9, 2018

(54) BOTTLE CAP WITH SELECTABLE ADDITIVES

(71) Applicant: Wojciech Zalewski, Belmont, MA (US)

(72) Inventor: Wojciech Zalewski, Belmont, MA (US)

(73) Assignee: ZM2 Design, LLC, Belmont, MA (US)

( * ) Notice: Subject to any disclaimer, the term of this patent is extended or adjusted under 35 U.S.C. 154(b) by 0 days.

(21) Appl. No.: 15/824,461

(22) Filed: Nov. 28, 2017

(65) Prior Publication Data

US 2018/0178957 A1 Jun. 28, 2018

Related U.S. Application Data

(60) Provisional application No. 62/426,863, filed on Nov. 28, 2016.

(51) Int. Cl.

| | |
|---|---|
| ***B65D 25/08*** | (2006.01) |
| ***B65D 51/28*** | (2006.01) |
| ***B65D 41/16*** | (2006.01) |
| ***B65D 41/04*** | (2006.01) |
| *B65D 81/32* | (2006.01) |

(52) U.S. Cl.

CPC ..... *B65D 51/2835* (2013.01); *B65D 41/04* (2013.01); *B65D 41/16* (2013.01); *B65D 81/3266* (2013.01)

(58) Field of Classification Search

CPC ..... B65D 25/08; B65D 41/04; B65D 41/16; B65D 51/2835; B65D 51/2857; B65D 51/2864; B65D 81/3266

USPC ..... 206/219–222, 568; 215/6, DIG. 8

See application file for complete search history.

(56) References Cited

U.S. PATENT DOCUMENTS

| | | | | |
|---|---|---|---|---|
| 8,453,833 | B2 * | 6/2013 | Porter | B65D 51/2871 206/222 |
| 8,613,372 | B2 | 12/2013 | Porter | |
| 8,714,808 | B2 * | 5/2014 | Yamanaka | B65D 51/2821 206/222 |
| 2004/0200742 | A1 * | 10/2004 | Cho | B65D 51/2835 206/219 |
| 2007/0102306 | A1 * | 5/2007 | Lantos | B65D 47/243 206/219 |
| 2010/0012193 | A1 * | 1/2010 | Anson | B65D 47/243 137/1 |
| 2012/0111744 | A1 * | 5/2012 | Chen | B65D 51/2821 206/222 |
| 2015/0028037 | A1 | 1/2015 | Porter | |
| 2016/0052685 | A1 | 2/2016 | Estes et al. | |

* cited by examiner

*Primary Examiner* — Luan K Bui
(74) *Attorney, Agent, or Firm* — Altman & Martin; Steven K Martin

(57) ABSTRACT

A cap for bottles that allows the user to select one or more additives. A base has an axis with a coaxial cavity, typically threaded, for attachment to the bottle. A housing rotates and reciprocates on the axis. A mechanism biases the housing from the base on the axis in a storage position. Pushing the housing against the biasing mechanism moves the housing to an operative position. Compartments arranged in a circle around the axis inside the housing hold the additives. An opening in the compartment bottom is covered by a frangible seal. As the housing rotates, the compartment openings align with an aperture in the base that extends into the cavity. Sharp spikes extending from the aperture puncture the seal when the housing is pushed to the operative position, thereby creating a hole for the additive to flow into the bottle.

8 Claims, 8 Drawing Sheets

BOTTLE CAP WITH SELECTABLE ADDITIVES

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to beverages, more particularly, to a device for putting selected additives in a beverage.

2. Description of the Related Art

Prior bottle caps have been used for sealing the container only. Some caps have the capacity to insert one liquid into the container. This is usually done to add a liquid that needs to be combined at the last minute before drinking. A bottle cap that can provide multiple liquids into a container has always been an unfulfilled need. This type of cap would give people a choice of how they can drink or use the liquid in the container/bottle. Liquids may be used in a discretionary manner. This can also provide a mixture that cannot be bought off the shelf. An example of this would be half a dose sugar and double dose of caffeine.

BRIEF SUMMARY OF THE INVENTION

The present invention is a cap for bottles that allows the user to select one or more additives for the contents of the bottle. The cap has a base and a housing.

The bottom of the base has an axis with a coaxial cavity for attachment to the bottle. Typically, the cavity will be threaded but can be designed for attachment to other types of bottles.

The housing is attached to the base to rotate about and reciprocate on the axis. In one configuration of the attachment, a coaxial hole in the housing has an annular protrusion at the opening. Fingers extend into the hole from the top of the base. Each finger has a radial lower surface ledge that prevents the fingers from coming out of the hole by abutting the hole protrusion. In another configuration, the housing is attached to the base by a cylindrical axle extending upwardly from the base into a cylindrical hole in the housing. Fingers extend radially inwardly into an annular groove in axle. In another configuration, the base fits within a recess in the housing and is retained in the recess by fingers extending radially from the bottom of the housing.

A biasing mechanism biases the housing from the base on the axis in a storage position. Biasing mechanisms include a rubber ring between the bottom of the housing and the top of the base, a coil spring between the housing and base, and a leaf spring between the housing and base.

The housing is moved toward the base to an operative position by pushing against and compressing the biasing mechanism. When the pressure is released, the biasing mechanism expands to push the housing away from the base to the storage position.

Several compartments inside the housing are filled with additives. The compartments are arranged in a circle around the axis. The compartment bottom has an opening that is covered by a frangible seal. As the housing rotates, the compartment openings sequentially align with an aperture in the base. The aperture extends into the cavity.

One or more sharp spikes extend upwardly from the aperture to puncture and open the seal. In the storage position, the seal is intact. When the housing is pushed to the operative position, the spikes puncture the seal to create a hole through which the additive flows into the aperture, cavity, and into the bottle.

Optionally, a ratchet mechanism permits the housing 12 to rotate in only one direction.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
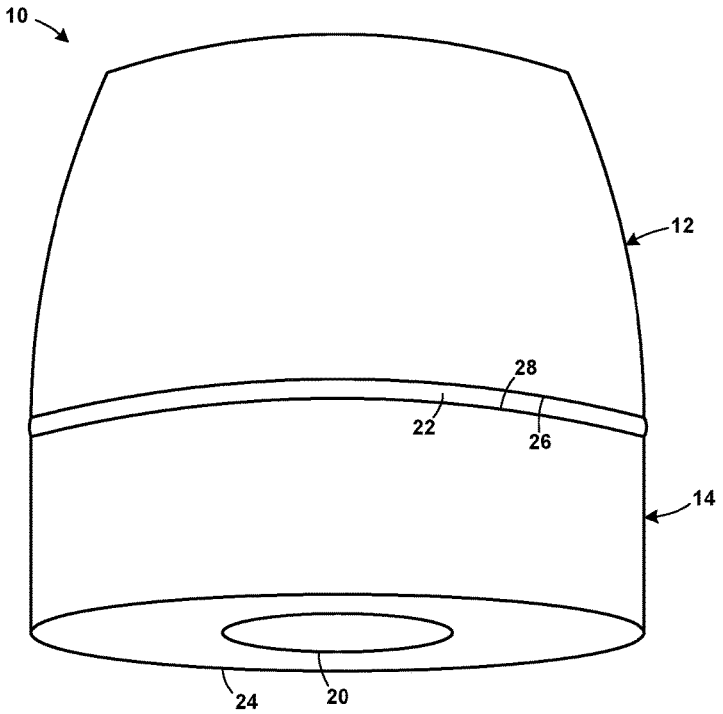
FIG. 1 is a perspective view of a first configuration of the cap of the present invention.

The present application hereby incorporates by reference in its entirety U.S. Provisional Patent Application No. 62/426,863, on which this application is based.

The present invention is a cap 10 for bottles or other containers (collectively, "bottle") that permits the user to select one or more of a number of additives to add to the contents of the bottle. Additives can include sugar, artificial sweetener, caffeine, vitamins, electrolytes, flavorings, medicines, etc. The additives can be any materials that flows easily by gravity. Examples include liquids and/or solids such as powders. Additives can be components of multi-part compounds, such as a two-part epoxy.

The cap 10 has a base 14 and a housing 12.

The base 14 has a coaxial cavity 20 in the bottom 24 for attachment to the bottle. The size of the cavity 20 depends on the size of the bottle opening for which the cap 10 is intended to be used. It can be small for soda bottles or large for large-mouth jars.

Figure 4:
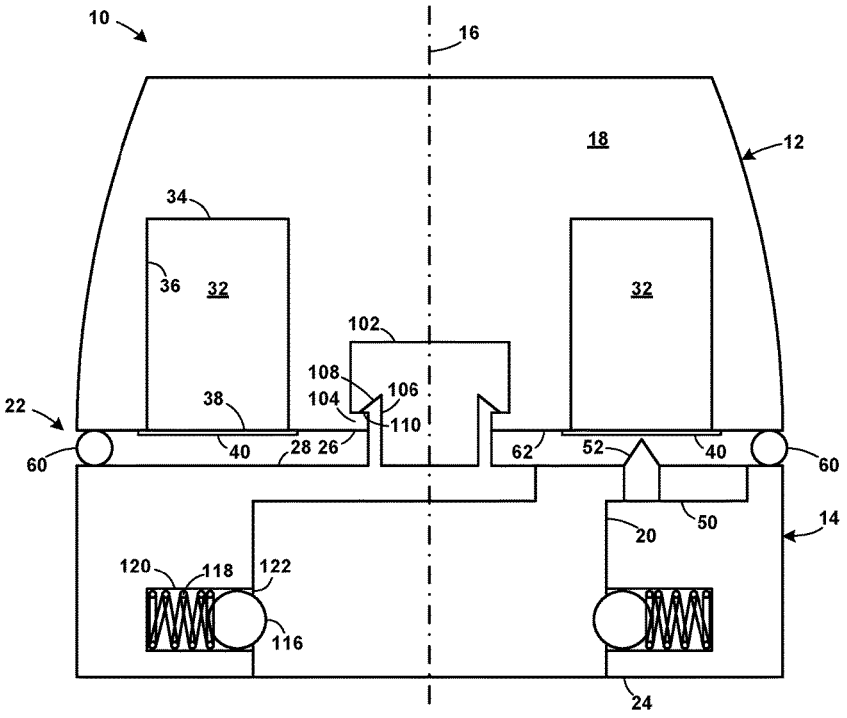
FIG. 4 is a side cross-sectional view of the configuration of FIG. 1 in the storage position.
Figure 5:
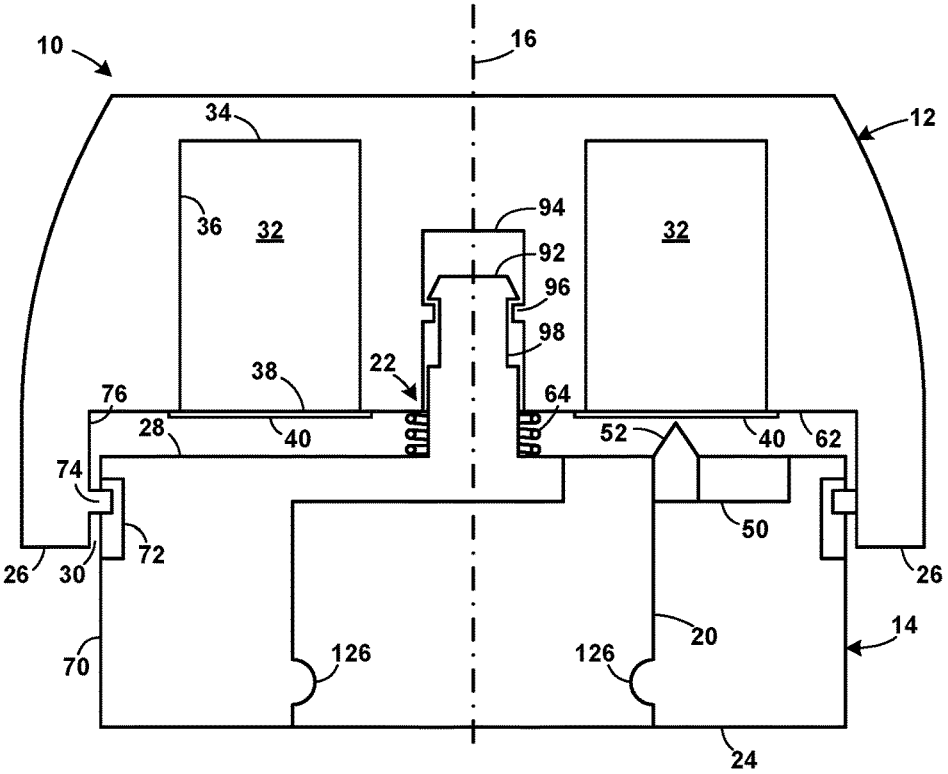
FIG. 5 is a side cross-sectional view of the configuration of FIG. 2 in the storage position.
Figure 6:
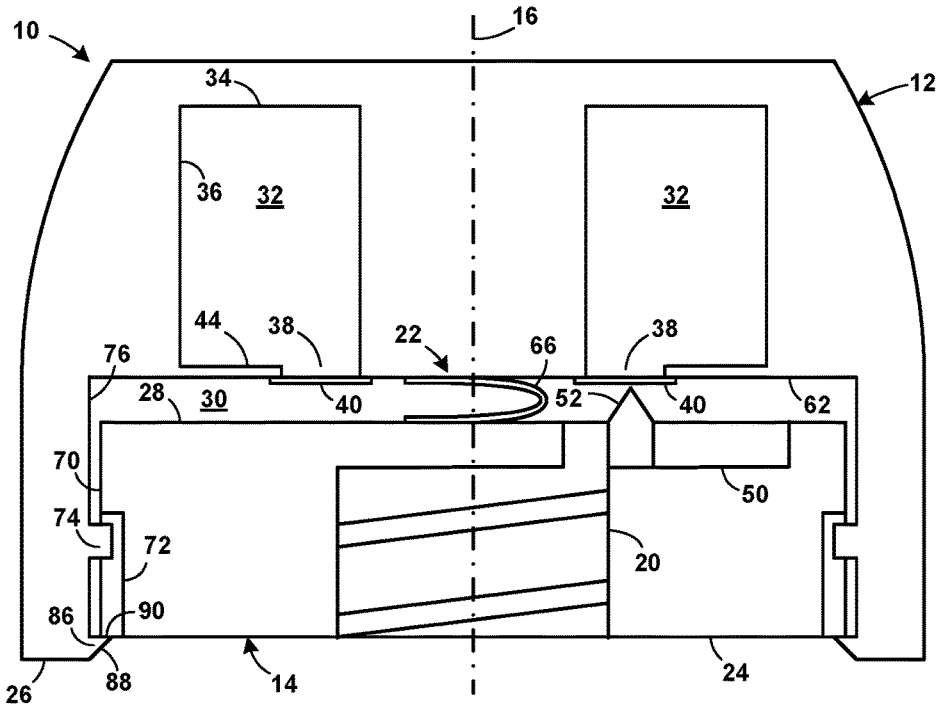
FIG. 6 is a side cross-sectional view of the configuration of FIG. 3 in the storage position.

Typically, the cavity 20 will be threaded, as in FIG. 6, so that the cap 10 can be screwed on to a threaded bottle opening. However, the present invention contemplates that the cavity 20 can be designed with other means of attachment that depend on the type of bottle the cap 12 is designed to be used with. In FIG. 4, the cavity 20 has opposed openings 120 with a ball bearing 116 biased outwardly by a spring 118. An annular wall retains the ball bearing 116 in the hole 120. When the cap 10 is pushed onto the bottle, the ball bearings 116 are pushed into the hole 120 against the spring 118 and then snap out when the rim of the bottle passes. In FIG. 5, the cavity 20 has an annular ring 126 that can compress. When the cap 10 is pushed onto the bottle, the ring compresses and then snaps back when the rim of the bottle passes.

The housing 12 is mounted to the base 14 so that it rotates about and reciprocates on the axis 16.

FIGS. 1-6 show three different configurations of the housing 12 and base 14 with three different mechanisms of attachment. Any of the attachment mechanisms can be used with any of the configurations. In the configuration of FIGS. 1 and 4, the bottom surface 26 of the housing 12 and the top surface 28 of the base 14 are shown as having the same size, but can be different sizes. This configuration shows a coaxial hole 102 in the operative surface 62 of the housing 12 with an annular protrusion 104 at the opening. At least three fingers 106 extend into the hole 102 from the top surface 28 of the base 14. The fingers 106 are evenly distributed around the hole 102. Each finger 106 has an upper beveled surface 108 that allows the housing 12 to be snapped onto the base 14 and a radial lower surface ledge 110 that prevents the fingers 106 from coming out of the hole 102 by abutting the hole protrusion 104.

Figure 2:
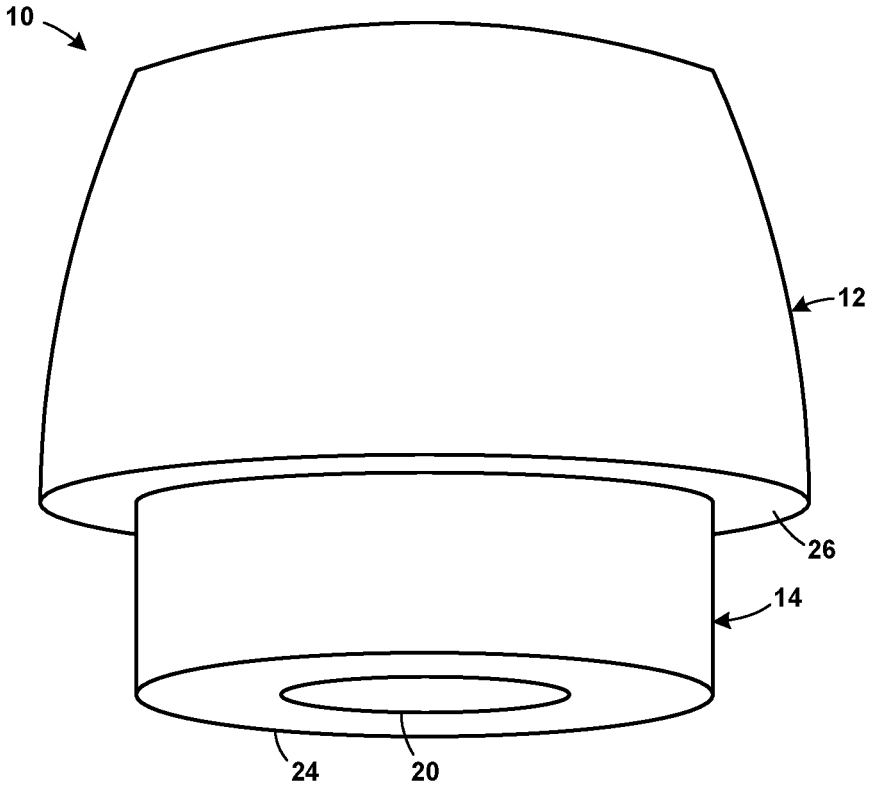
FIG. 2 is a perspective view of a second configuration of the cap of the present invention.

In the configuration of FIGS. 2 and 5, the diameter of the top surface 28 of the base 14 is smaller than the bottom 26 of the housing 12 and the top portion of the base 14 fits within a recess 30 in the housing 12. This configuration shows the housing 12 attached to the base 14 by a cylindrical axle 92 extending upwardly from the top surface 28 of the base 14 into a cylindrical hole 94 in the operative surface 62 of the housing 12. At least two fingers 96 extending radially inwardly from the hole 94 fit into an annular groove 98 in the surface of the axle 92. The groove 98 is wide enough and the fingers 96 narrow enough to permit the housing 12 to reciprocate on the axle 92.

Figure 3:
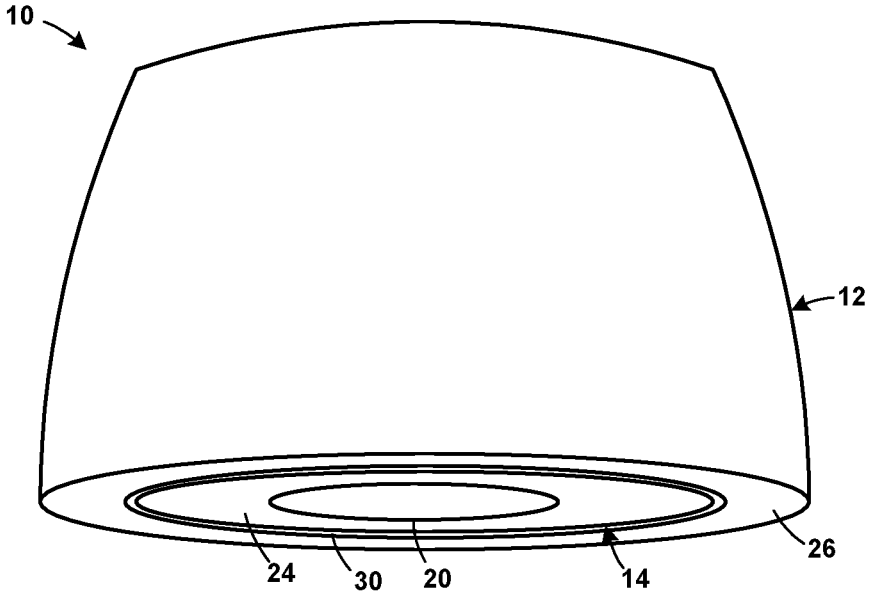
FIG. 3 is a perspective view of a third configuration of the cap of the present invention.

In the configuration of FIGS. 3 and 6, the diameter of base 14 is smaller than the bottom 26 of the housing 12 and the entire base 14 fits within a recess 30 in the housing 12. This configuration shows the housing 12 attached to the base 14 by at least two fingers 86 extending radially from the bottom 26 of the housing 12 or, as shown in FIG. 6, the wall 76 of the recess 30 adjacent to the bottom 26 of the housing 12. The fingers 86 are distributed evenly around the perimeter of the recess 30. Each finger 86 has an outer beveled surface 88 that allows the base 14 to be snapped into the recess 30 and a radial upper surface ledge 90 that prevents the base 14 from coming out of the recess 30 by abutting the bottom 24 of the base 14. Alternatively, instead of separate fingers 86, an annular ring extends radially from the wall 76 of the recess 30 at the bottom 26 of the base 14. Like the fingers 86, the annular ring has an outer beveled surface and radial upper surface ledge. References to the fingers 86 in the claims is intended to include the annular ring.

A biasing mechanism 22 biases the housing 12 from the base 14 on the axis 16 in a storage position. Three different biasing mechanisms 22 are shown in FIGS. 4-6, although any mechanism that can provide a bias can be used. The biasing mechanism 22 shown in FIG. 4 is a ring 60 of rubber or other compressible material that fits between the bottom of the housing 12 and the top of the base 14. The biasing mechanism 22 shown in FIG. 5 is a coil spring 64 that fits between the operative surface 62 of the housing 12 and the top 28 of the base 14. The biasing mechanism 22 shown in FIG. 6 is one or more leaf springs 66 that fit between the operative surface 62 of the housing 12 and the top 28 of the base 14. The springs 64, 66 can be composed of metal, plastic, or other appropriate material. Any biasing mechanism 22 can be used with in configuration of the cap 10.

The housing 12 is moved toward the base 14 to an operative position by pushing against and compressing the biasing mechanism 22. When the pressure is released, the biasing mechanism 22 expands to push the housing 12 away from the base 14, from the operative position to the storage position.

Figure 7:
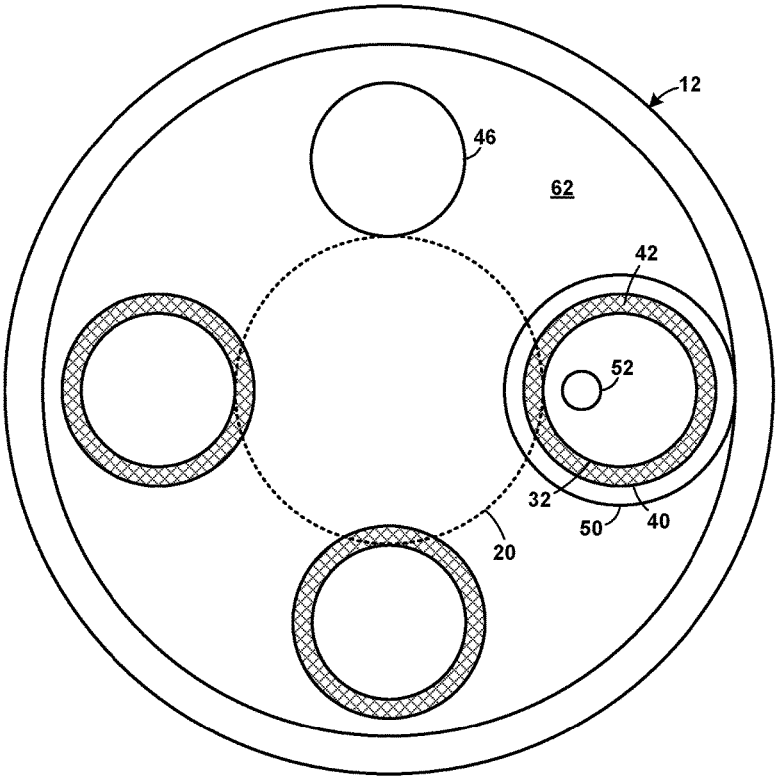
FIG. 7 is a cross-sectional view between the base and housing.

Inside the housing 12 are several compartments 32 that are filled with additives that the user may wish to add to the contents of the bottle. The compartments 32 are arranged in a circle around the axis 16, as in FIG. 7. Each compartment 32 has a shape and size to hold a predetermined amount of an additive.

The top 34 and side 36 of the compartment 32 are closed and the bottom has an opening 38 in the operative surface 62 of the housing 12. In one configuration, shown in FIGS. 4 and 5, the entire bottom is the opening 38. In another configuration, shown in FIG. 6, the bottom is partially closed as at 44 with an opening 38.

The opening 38 is covered by a frangible seal 40, such as a foil or plastic sheet that can be pierced by a sharp object. Alternatively, the seal 40 can be a thin sheet of the same material as the housing 12. The seal 40 should be designed so that, when pierced as described below, it does not break into pieces that end up in the additive.

In the figures, a single foil seal 40 is shown for each compartment 32. However, the present invention contemplates that there may be a single sheet of seal material that covers all of the compartments 32 in use. The seal 40 is attached to the operative surface 62 of the housing 12 by whatever means is appropriate, for example, by a ring of adhesive 42, as in FIG. 7. Prior to attaching the seal 40, the compartments 32 are filled with the additives.

One location around the perimeter either does not have a compartment 32 or the compartment 32 is empty and without a seal 34. This is the closed location 46.

Figure 8:
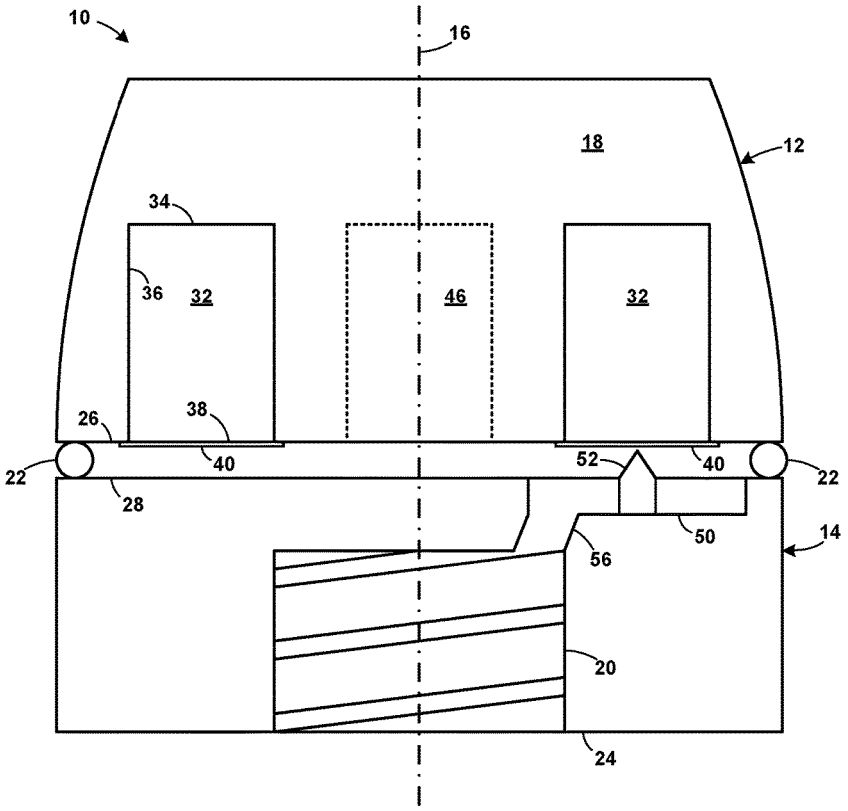
FIG. 8 is a side cross-sectional view of the configuration of FIG. 1 in the storage position with a tube from the aperture to the cavity.

As described above, the housing 12 rotates relative to the base 14. In one configuration, shown in FIGS. 4-6, the top surface of the base 14 has an aperture 50 that extends into the cavity 20. In another configuration, shown in FIG. 8, if the aperture 50 is not aligned enough with the cavity 20, a tube 56 extends between the aperture 50 and cavity 20 to provide a conduit for the additive to the cavity 20. References in the present specification and claims to the aperture 50 are intended to encompass both configurations.

As the housing 12 rotates, each compartment 32 becomes aligned with the aperture 50. When the closed location 46 is aligned with the aperture 50, the housing 12 is in the closed position where none of the additives can be added to the bottle.

Figure 9:
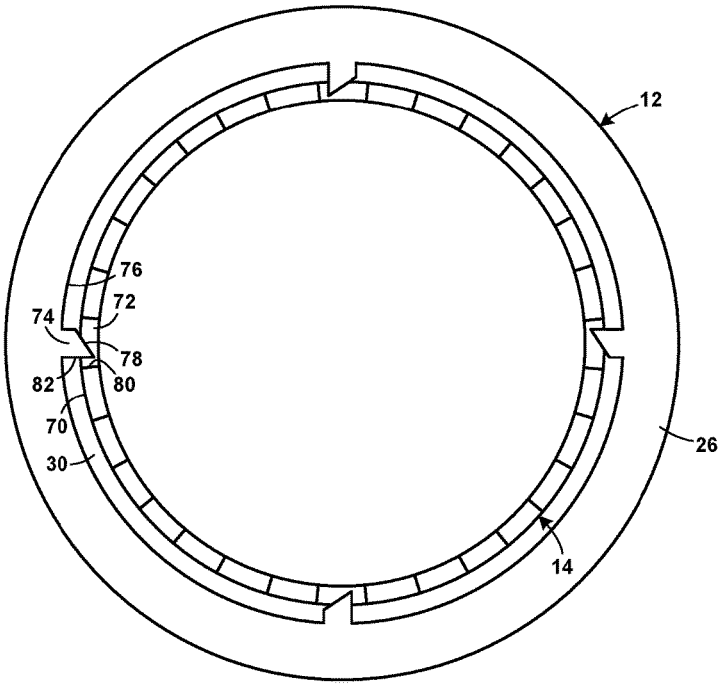
FIG. 9 is a bottom cross-sectional view of a ratchet of the configuration of FIG. 3.

Optionally, a ratchet mechanism permits the housing 12 to rotate in only one direction. A ratchet mechanism for the present invention is shown in FIG. 9. Paraxial grooves 72 extend around the perimeter surface 70 of the base 14. One or more beveled fingers 74 extend radially from the perimeter surface 76 of the housing recess 30. In the ratchet mechanism of FIG. 9, the bevel 78 of the finger 74 permits the housing 12 to rotate clockwise. However, when trying to rotate the housing 12 counterclockwise, the finger surface 82 hits the groove wall 80, preventing rotation. The present invention contemplates that the ratchet mechanism can be reversed, with the grooves 72 on the housing 12 and the fingers 74 on the base 14.

Optionally, mechanical detents stop the housing 12 when a compartment 32 is aligned with the aperture 50. A detent mechanism can operate similarly to the ratchet mechanism, where the grooves 72 are only aligned with the compartments 32.

Figure 10:
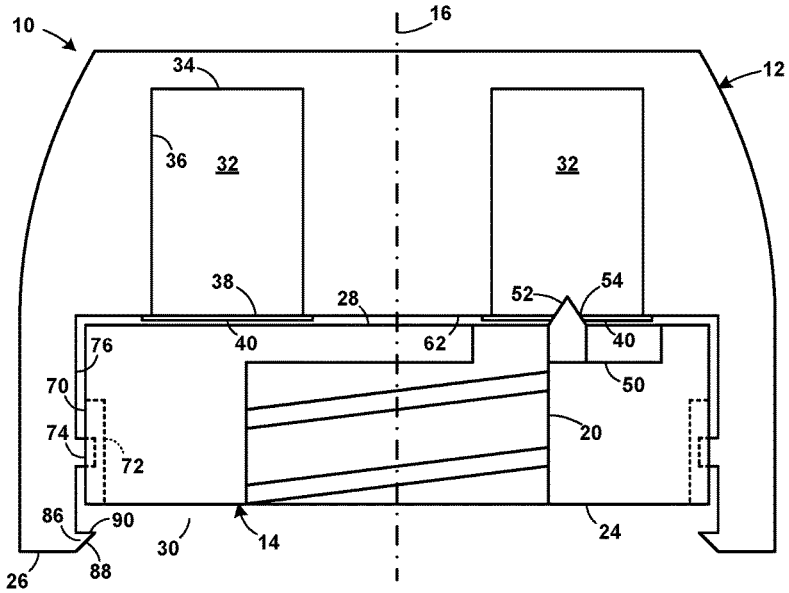
FIG. 10 is a side cross-sectional view of the configuration of FIG. 3 in the operative position.

Extending upwardly from the aperture 50 is a one or more sharp spikes 52 that are designed to puncture and open the seal 40. When in the storage position, the seal 40 is intact. When the housing 12 is pushed to the operative position, the spikes 52 puncture the seal 40, as in FIG. 10. The spikes 52 create a hole 54 through which the additive flows into the cavity 20 and ultimately into the bottle.

The present invention contemplates several ways in which the additive can flow into the aperture 50. The spikes 52 can have passages through which the additive flows. The spikes 52 can produce a ragged hole 54 in the seal 40 so that the additive flows around the spikes 52. The spikes 52 produce and block the holes 54 so that the housing 12 must return to the storage position to unblock the holes 34 so that the additive can flow into the aperture 50.

Optionally, there is a guard that reduces or prevents splashing as the additive moves from the compartment 32 to the cavity 20. In one configuration, a downwardly-extending wall circles to compartment opening 38. When the housing 12 is pushed toward the base 14 to pierce the seal 40, the wall abuts the top 28 of the base 14 around the aperture 50 to prevent splashing. In another configuration, an upwardly extending wall circles the aperture 50. When the housing 12 is pushed toward the base 14 to pierce the seal 40, the wall abuts the bottom 26 of the housing 12 around the compartment opening 38 to prevent splashing.

Thus it has been shown and described a bottle cap with selectable additives. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A cap for a bottle with an opening, the cap comprising:

(a) a base having an axis, a top surface, a bottom surface, a cavity in the bottom surface designed to attach to the bottle opening, and an aperture extending from the top surface to the cavity;

(b) a housing mounted to rotate about and reciprocate on the axis and having a bottom surface, an operative surface, and a plurality of compartments arranged in a circle around the axis inside the housing, each compartment having an opening in the operative surface covered by a frangible seal, at least one of the compartments containing an additive;

(c) a biasing mechanism biasing the housing operative surface away from the base top surface along the axis;

(d) at least one spike extending toward the frangible seal from the aperture;

(e) the housing rotatable on the axis such that each of the compartment openings can align with the aperture;

(f) the housing reciprocating on the axis between a storage position wherein the biasing mechanism is biasing the housing operative surface away from the base top surface and the frangible seal associated with a compartment aligned with the aperture is intact, and an operative position wherein the housing is pushed toward the base against the biasing mechanism and the spike pierces the frangible seal associated with the compartment aligned with the aperture thereby allowing the additive to flow downwardly into the aperture and into the cavity.

2. The cap of claim 1 wherein the cavity is threaded for attachment to a screw-top bottle.

3. The cap of claim 1 wherein the cavity has a snap-on attachment for the bottle.

4. The cap of claim 1 further comprising a ratchet mechanism that permits rotation of the housing in only one direction.

5. The cap of claim 1 wherein the base is mounted within a recess in the housing bottom.

6. The cap of claim 5 wherein the base is retained in the housing recess by fingers extending radially into the recess from adjacent the housing bottom surface.

7. The cap of claim 1 wherein the seal is a thin sheet attached to the housing operative surface by an adhesive.

8. The cap of claim 1 wherein the housing is composed of a housing material and the seal is a thin sheet of housing material.

* * * * *